US007583243B2

(12) United States Patent
Yamazaki et al.

(10) Patent No.: US 7,583,243 B2
(45) Date of Patent: Sep. 1, 2009

(54) PIXEL CIRCUIT, METHOD OF DRIVING THE SAME, ELECTRO-OPTICAL DEVICE, AND ELECTRONIC APPARATUS

(75) Inventors: Katsunori Yamazaki, Matsumoto (JP); Shoichi Iino, Nirasaki (JP)

(73) Assignee: Seiko Epson Corporation, Tokyo (JP)

( * ) Notice: Subject to any disclaimer, the term of this patent is extended or adjusted under 35 U.S.C. 154(b) by 513 days.

(21) Appl. No.: 11/107,828

(22) Filed: Apr. 18, 2005

(65) Prior Publication Data

US 2006/0007071 A1 Jan. 12, 2006

(30) Foreign Application Priority Data

Jul. 8, 2004 (JP) ..... 2004-202220

(51) Int. Cl.
*G09G 3/30* (2006.01)

(52) U.S. Cl. ..... 345/77; 345/76; 345/82

(58) Field of Classification Search ..... 345/55, 345/82–84, 76–77, 90, 92, 204–205, 690, 345/214

See application file for complete search history.

(56) References Cited

U.S. PATENT DOCUMENTS

| | | | | |
|---|---|---|---|---|
| 5,786,796 | A * | 7/1998 | Takayama et al. | 345/76 |
| 5,942,856 | A | 8/1999 | Koyama | |
| 6,097,356 | A * | 8/2000 | Fan | 345/60 |
| 6,229,508 | B1 * | 5/2001 | Kane | 345/82 |
| 6,473,065 | B1 * | 10/2002 | Fan | 345/82 |
| 6,661,180 | B2 * | 12/2003 | Koyama | 315/169.3 |
| 6,774,577 | B2 | 8/2004 | Choi | |
| 7,015,884 | B2 | 3/2006 | Kwon | |
| 7,205,965 | B2 * | 4/2007 | Mikami et al. | 345/76 |
| 7,205,966 | B2 * | 4/2007 | Numao | 345/76 |
| 7,271,785 | B2 * | 9/2007 | Jang | 345/80 |
| 2002/0140659 | A1 * | 10/2002 | Mikami et al. | 345/90 |
| 2003/0067424 | A1 * | 4/2003 | Akimoto et al. | 345/55 |
| 2004/0239654 | A1 * | 12/2004 | Okuda | 345/204 |

FOREIGN PATENT DOCUMENTS

| | | |
|---|---|---|
| JP | A 10-197896 | 7/1998 |
| JP | A 2003-066903 | 3/2003 |
| KR | A 2002-0056353 | 7/2002 |
| KR | A 10-2004-0009573 | 1/2004 |

* cited by examiner

*Primary Examiner*—Alexander Eisen
*Assistant Examiner*—Jason M Mandeville
(74) *Attorney, Agent, or Firm*—Oliff & Berridge, PLC

(57) ABSTRACT

A method of driving a pixel circuit, which has a driving transistor for making a current according to a gate voltage flow into a driven element, a resistive element electrically connected in series to the driven element, and a switching transistor provided between the gate of the driving transistor and a data line to be turned on/off, includes first turning on the switching transistor and applying a voltage according to a target current flowing into the driven element to the data line, second turning off the switching transistor, third turning on the switching transistor and applying an added voltage obtained by adding a voltage across the resistive element to the voltage according to the target current to the data line, and fourth turning off the switching transistor and reducing the gate voltage of the driving transistor by the voltage across the resistive element in the third turning on.

6 Claims, 12 Drawing Sheets

(1) FIRST FRAME SELECTION PERIOD (2) FIRST FRAME NON-SELECTION PERIOD (3) SECOND FRAME SELECTION PERIOD (4) SECOND FRAME NON-SELECTION PERIOD

PIXEL CIRCUIT, METHOD OF DRIVING THE SAME, ELECTRO-OPTICAL DEVICE, AND ELECTRONIC APPARATUS

BACKGROUND OF THE INVENTION

1. Technical Field

The present invention relates to a pixel circuit having a driven element, such as an organic light-emitting diode element, which is driven by a current, a method of driving the pixel circuit, an electro-optical device, and an electronic apparatus.

2. Related Art

In recent years, as a next-generation light-emitting device and as an alternative to the liquid crystal elements, an organic light-emitting diode element (hereinafter, referred to as 'an OLED element') called an organic electroluminescent element or a light-emitting polymer element has been drawing considerable attention. The OLED elements have a low viewing angle dependency because they are self-emitting elements. Further, since backlight or reflected light is not required, the OLED elements have excellent characteristics such as low power consumption and a reduced thickness as a display panel.

The OLED elements are current driven elements in which the light-emitting state cannot be maintained when the current is blocked because they do not have the voltage maintenance like the liquid crystal elements. Thereby, in the case of driving the OLED elements in an active matrix manner, the structure has been generally used, in which the voltage according to the gray scale degree of a pixel is applied into the gate of a driving transistor to hold the voltage by the gate capacity or a capacitive element during a writing period (selection period) and the driving transistor makes the current according to the gate voltage to flow into the OLED element continuously.

However, in this structure, there is a problem in that the luminance of the OLED element is different for each pixel by the deviation in the characteristics of the driving transistor to deteriorate the quality of display. For this reason, despite the presence of the deviation in the characteristics of the driving transistor, various types of technologies for suppressing the deviation of the current flowing into the driven element have been suggested. For example, there is a technology in which the deviation is offset by forming a current mirror circuit with at least two sets (four or more) of transistor groups (Japanese Unexamined Patent Application Publication 10-197896 is an example of related art) or a technology in which the deviation is offset by periodically changing the corresponding relationship between the current supplying circuit and the current supply destination. Japanese Unexamined Patent Application Publication 2003-66903 is another example of related art.

However, in the technology disclosed in Japanese Unexamined Patent Application Publication 10-197896, because of the difference in the manufacturing processes, there is a possibility that the deviation in the current still remains. Particularly, a large display apparatus has a tendency for having a greater deviation, and thus it is difficult to overcome the nonuniformity in the display. Also, in the technology disclosed in Japanese Unexamined Patent Application Publication 2003-66903, since the deviation is asymmetrically distributed in each block of the current supplying destination, there is a problem in that the nonuniformed display having a block shape is often generated.

SUMMARY

An advantage of the invention is that it provides a pixel circuit, a method of driving the pixel circuit, an electro-optical device, and an electronic apparatus in which the influences from the deviation in the characteristics of the driving transistor are prevented.

According to a first aspect of the invention, there is provided a method of driving a pixel circuit having a driving transistor for making a current according to a gate voltage flow into a driven element, a resistive element electrically connected in series to the driven element, and a switching transistor provided between a gate of the driving transistor and a data line to be turned on/off. The driving method comprises first turning on the switching transistor and applying the voltage according to a target current flowing into the driven element to the data line; second turning off the switching transistor to be turned off, third turning on the switching transistor and applying an added voltage obtained by adding a voltage across the resistive element to the voltage according to the target current to the data line, and fourth turning off the switching transistor and reducing the gate voltage of the driving transistor by the voltage across the resistive element in the third turning on. In this case, when the current flowing into the driven element by the driving transistor is shift from a target current by the characteristics of the driving transistor in the second turning off, the current for offsetting the shift amount flows into the driven element in the fourth turning off.

In this case, a period for which the current is flowed to the driven element by the first turning on and second turning off and a period for which the current is flowed to the driven element by the third turning on and fourth turning off have substantially the same time length, and the first turning on and second turning off and the third turning on and fourth turning off are alternately performed. As a result, the current value flowing into the driven element is substantially the same as the object current value.

According to a second aspect of the invention, there is provided a pixel circuit in addition to the driving method. In consideration of the pixel circuit, it is preferable that a capacitive element whose one end is connected to the gate of the driving transistor and a single pole double throw switch whose the common port is connected to the other end of the capacitive element, one port is connected to a potential line held with a predetermined potential, and the other end is connected to one end of the resistive element be comprised. In addition, it is preferable that the signal pole double throw switch close the common port and one port thereof during the selection period and the non-selection period of the first frame and the non-selection period of the second frame, and close the common port the other port thereof during the selection period of the second frame. Also, it is preferable that the driven element be an electro-optical element for emitting the light with the luminance according to the flowing current.

According to a third aspect of the invention, there is provided an electro-optical device or an electronic apparatus having the electro-optical device, in addition to the pixel circuit and the method of driving the pixel circuit.

BRIEF DESCRIPTION OF THE DRAWINGS

The invention will be described with reference to the accompanying drawings, wherein like numbers reference like elements, and wherein.

DESCRIPTION OF THE EMBODIMENTS

Figure 1:
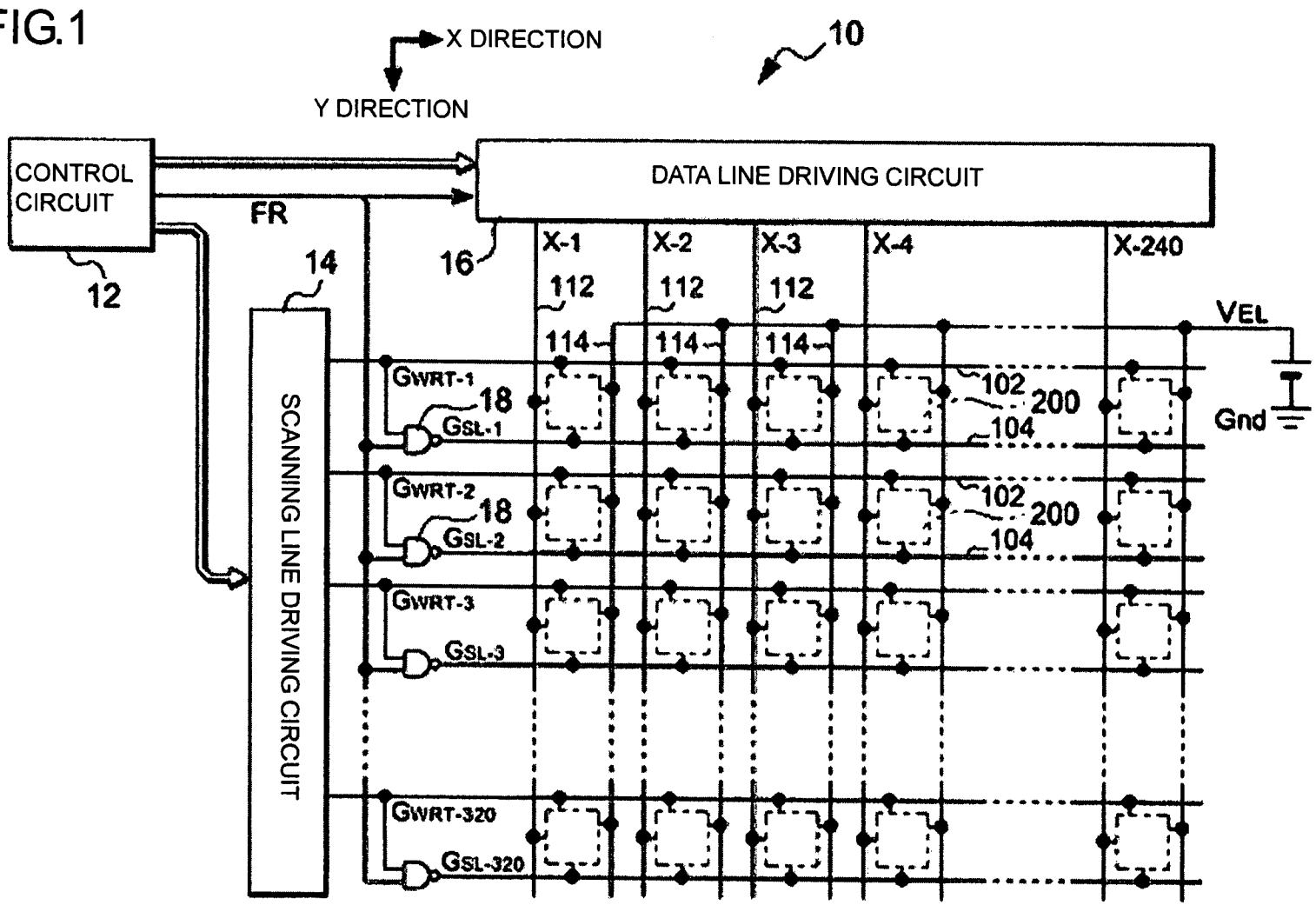
FIG. 1 is a block diagram showing the structure of an electro-optical device according to an embodiment of the present invention.
Figure 2:
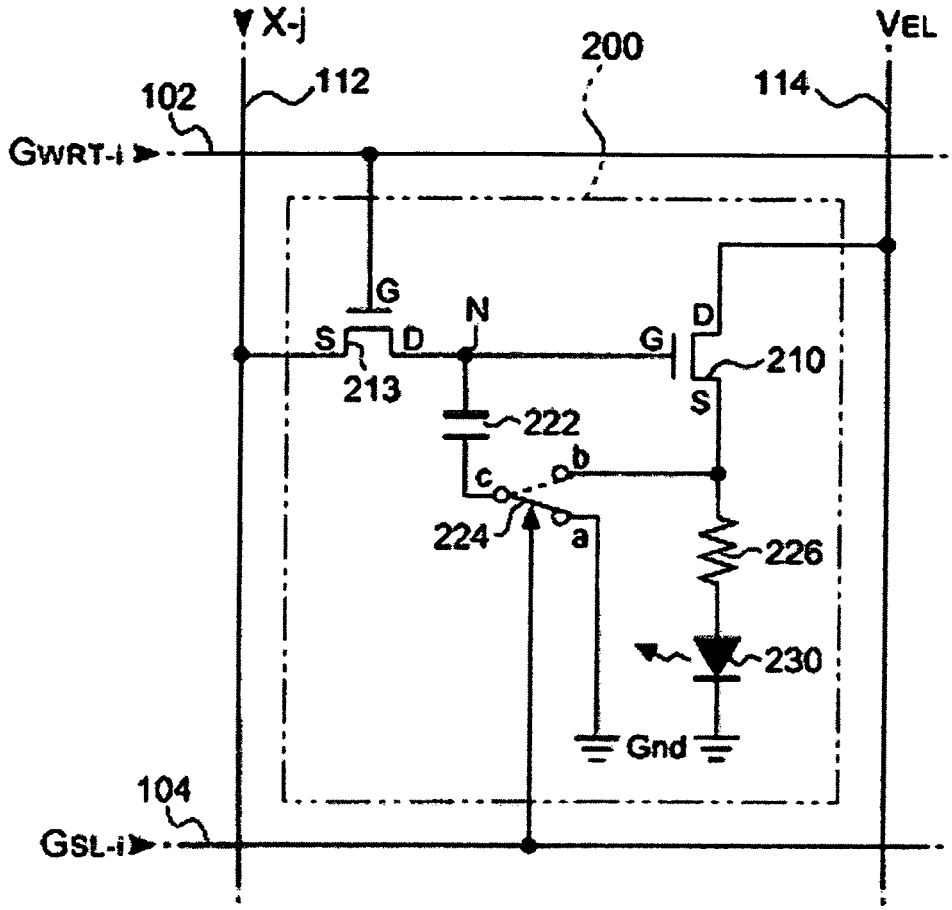
FIG. 2 is a diagram showing a pixel circuit of the electro-optical device.

Next, embodiments of the present invention will be described with reference to the accompanying drawings. FIG. 1 shows the structure of an electro-optical device according to an embodiment of the invention. FIG. 2 shows the structure of a pixel circuit of the electro-optical device.

Firstly, as shown in FIG. 1, in an electro-optical device 10, a plurality of scanning lines 102 is arranged in a horizontal direction (X direction) and a plurality of data lines 112 is arranged in a vertical direction (Y direction) in FIG. 1. In addition, a pixel circuit 200 is provided so as to correspond to the intersection of the scanning line 102 and the data line 112.

For convenience of explanation, in the present embodiment, the number of the scanning lines 102 (the number of rows) is 320, the number of the data lines (the number of columns) is 240, and thus the pixel circuits 200 are arranged in a matrix of 320 vertical rows×240 horizontal columns. However, the invention is not limited to this arrangement.

Furthermore, the pixel circuit 200 includes an OLED element, which will be described in detail later, and a predetermined image is gray scale displayed by controlling the current into the OLED element for each pixel circuit 200.

In addition, as shown in FIG. 1, control lines 104 are arranged in the X direction such that each control line 104 forms a couple with each scanning line 102.

A control circuit 12 supplies clock signals (not shown) to a scanning line driving circuit 14 and a data line driving circuit 16 to control both of the driving circuits and supplies gray scale data for defining the gray scale degree for each pixel to the data line driving circuit 16. Also, the control circuit 12 outputs a frame signal FR whose logic level is inverted for one frame (vertical scanning period). Thereby, the frame has two kinds of frame signals, that is, a frame signal FR having a low level and a frame signal FR having a high level. To distinguish them from each other, for convenience, a frame whose frame signal Fr has the low level and a frame whose frame signal Fr has the high level are referred to as a first frame and a second frame, respectively (see FIG. 3). In addition, in FIG. 3, it goes without saying that the lengths of the periods of the first and second frames are equal to each other.

The scanning line driving circuit 14 selects the scanning line 102 by one row every one horizontal scanning period and supplies the scanning signal having the H level to the selected scanning line 102. Here, for convenience of the explanation, the scanning signal supplied to the scanning line 102 of the i-th row (i is an integer satisfying $1 \leqq i \leqq 320$ and is to generalize the row) is represented as $G_{WRT-i}$.

For each row, an NAND circuit 18 is provided. The NAND circuit obtains an NAND signal of the scanning signal and the frame signal FR and supplies it to the control line 104 as the control signal. Here, the control signal supplied to the control line 104 of the i-th row is represented as $G_{SL-i}$.

The data line driving circuit 16 converts the gray scale data of one row (1 to 240-th columns) located at the selected scanning line 102 into analog voltage signals by using the below-described algorithm and supplies them to the data lines 112 of the 1 to 240-th columns as data signals X-1 to X-240. In the present embodiment, the data line driving circuit 16 is supplied with the frame signals FR to discriminate the frames because the algorithms used in the first and second frames are different from each other.

Furthermore, in the present embodiment, it is designated that the higher the voltage of the data signal is, the brighter the pixel is and the lower the voltage of the data signal, the darker the pixel is. This reason is because the below-described driving transistor is an n-channel type.

In addition, for convenience for the explanation, the data signal supplied to the data line 112 of the j-th column (j is an integer satisfying $1 \leqq j \leqq 240$ and is to generalize the column) is represented as X-j.

Also, all the pixel circuits 200 are supplied with a high potential voltage $V_{EL}$ which becomes the power supply voltage of the OLED element through the power line 114 and all the pixel circuits 200 are commonly connected to an electric potential Gnd which is the voltage reference.

In the present embodiment, all the pixel circuits 200 arranged in a matrix have a common structure. Therefore, the structure of the pixel circuit 200 will be described by using the pixel circuit located at the i-th row and the j-th column as a representative.

As shown in FIG. 2, the pixel circuit 200 has an n-channel driving transistor 210, an n-channel switching transistor 213, a capacitive element 222, a switch 224, a resistive element 226, and an OLED element 230 serving as an electro-optical element.

Among them, the switching transistor 213 has a gate (G) connected to the scanning line 102 of the i-th row, a source (S) connected to the data line 112 of the j-th column, and a drain (D) connected to one end of the capacitive element 222 and a gate (G) of the driving transistor 210.

The driving transistor 210 has a drain (D) connected to the power line 114 and a source (S) connected to one end of the resistive element 226 and a port b of the switch 224. The other end of the resistive element 226 is connected to an anode of the OLED element 230 and a cathode of the OLED element 230 is connected to the electric potential Gnd.

As a result, in the current path between the high potential voltage $V_{EL}$ of the power supply and the ground potential Gnd, the OLED element 230 and the resistive element 226 electrically connected in series to each other are inserted and the current flowing through the path is controlled according to the gate voltage of the driving transistor 210.

On the other hand, the other end of the capacitive element 222 is connected to a port c (common port) of the switch 224. The switch 224 is a single pole double throw switch for selecting any one of the ports a and b according to the logic level of the control signal $G_{SL-i}$ and closing the selected port and the port c. Specifically, in the case in which the control signal $G_{SL-i}$ supplied to the control line 104 of the i-th row is the H level, the port a is selected and the ports c and a are closed as shown by the solid line in FIG. 2. On the other hand, in the case in which the control signal $G_{SL-i}$ is the L level, the port b is selected and the ports c and b are closed as shown by the broken line in FIG. 2. The port a of the switch 224 is connected to the ground potential Gnd and the port b is connected to the source of the driving transistor 210 and one end of the resistive element 226 as described above.

Also, for convenience of explanation, one end of the capacitive element 222 (the gate of the driving transistor 210 and the drain of the switching transistor 213) is referred to as a node N.

Moreover, the pixel circuits 200 arranged in a matrix are formed on a transparent substrate such as glass, together with the scanning line 102 or the data line 112. For this reason, the driving transistor 210, the switching transistor 213, and the switch 224 are composed of TFTs (thin film transistors) by the polysilicon process. Also, the resistive element 226 is made of polysilicon. Also, on the substrate, the OLED element 230 uses a transparent electrode film such as ITO (Indium Tin Oxide) as an anode (separate electrode) and uses a simple metal film such as aluminum or lithium or the laminated film thereof as a cathode (common electrode) with a light-emitting layer interposed therebetween.

Figure 3:
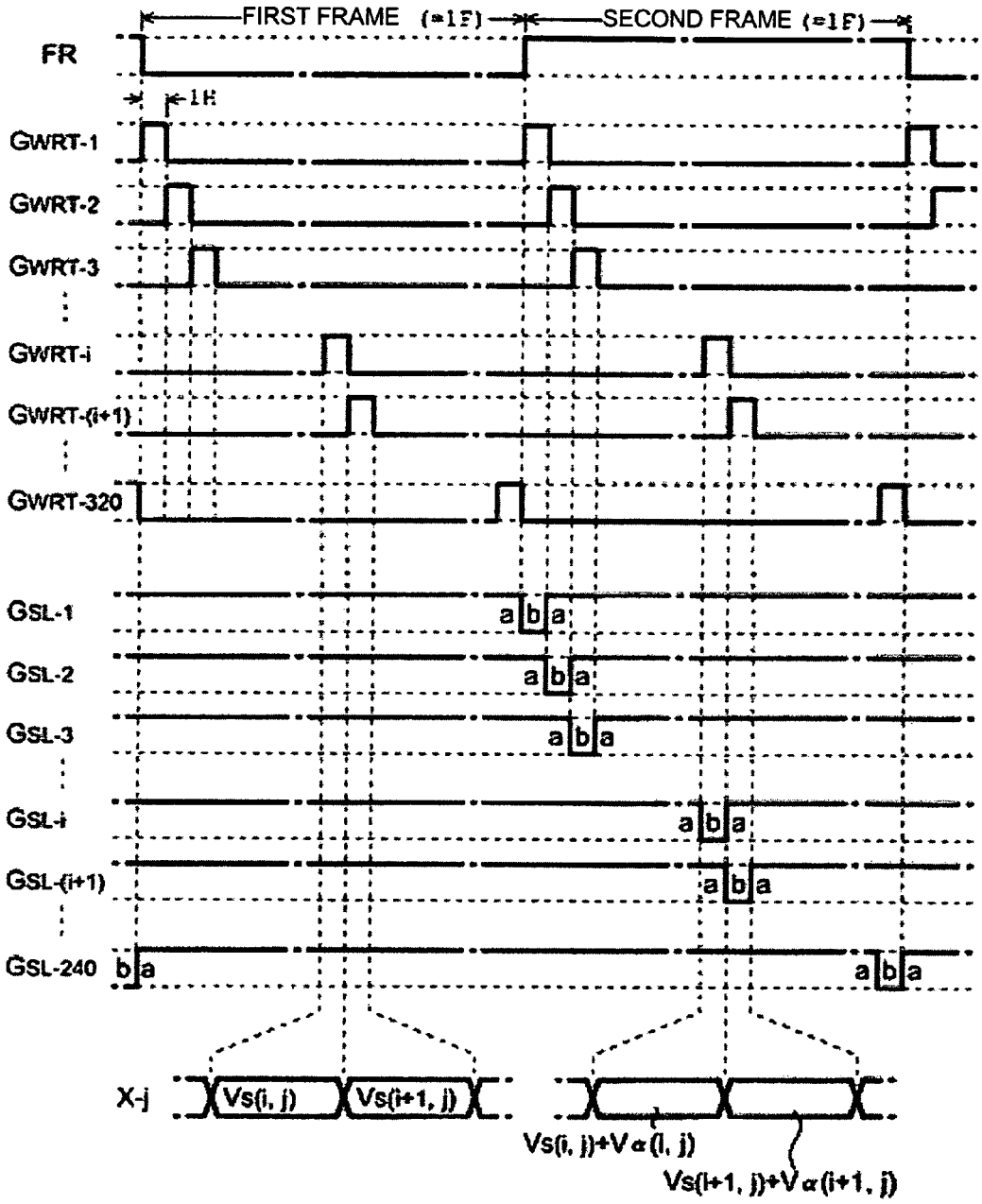
FIG. 3 is a timing chart showing the operation of the electro-optical device.

Next, the operation of the electro-optical device 10 will be described. FIG. 3 is a timing chart for explaining the operation of the electro-optical device 10.

First, as shown in FIG. 3, the scanning line driving circuit 14 selects the scanning lines 102 of the first, second, third, . . . , and 320-th rows in sequence one by one for one horizontal scanning period (1H) from the beginning of one vertical scanning period (1F), causes only the scanning signal of the selected scanning line 102 to become the H level and causes the scanning signals of the other scanning lines to become the L level.

On the other hand, as shown in FIG. 3, the control signals $G_{SL-1}$ to $G_{SL-320}$ output from each row of NAND circuit 18 become the H level regardless of the logic level of the scanning signal because the frame signal FR becomes the L level in the case of the first frame. On the other hand, the control signals $G_{SL-1}$ to $G_{SL-320}$ output from each row of NAND circuit 18 become the L level only when the corresponding scanning signal becomes the H level because the frame signal becomes the H level in the case of the second frame.

Figure 4A:
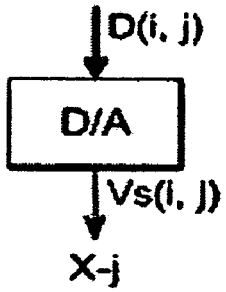
FIG. 4 is a diagram showing the operation of a data line driving circuit in the electro-optical device.

Here, in the first frame, the data line driving circuit 16 uses the algorithm shown in FIG. 4A for each column, when converting the gray scale data into the analog voltage signal. Specifically, in the first frame, the data line driving circuit 16 simply converts the gray scale data D(i, j) corresponding to the pixel of the i-th row and the j-th column into the analog signal of the voltage $V_s$(i, j) as it is and supplies it to the data line 112 of the j-th column as the data signal X-j, during the horizontal scanning period that the scanning signal $G_{WRT-i}$ becomes the H level. The data line driving circuit 16 simultaneously performs such a converting operation with respect to the columns other than the j-th column.

Furthermore, in the first frame, the data line driving circuit 16 converts the gray scale data D(i+1, j) corresponding to the pixel of the (i+1)-th row and the j-th column into the analog signal of the voltage $V_s$(i+1, j) as it is and supplies it to the data line 112 of the j-th column as the data signal X-j, during the horizontal scanning period that the next scanning signal $G_{WRT-(i+1)}$ becomes the H level.

Figure 4B:
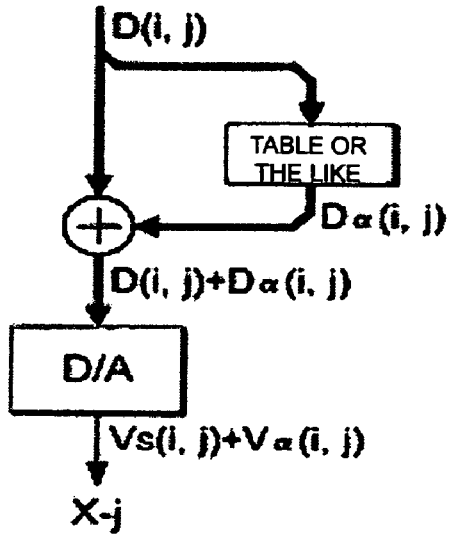

On the other hand, in the second frame, the data line driving circuit 16 uses the algorithm shown in FIG. 4B for each column, when converting the gray scale data into the analog voltage signal. Specifically, in the second frame, the data line driving circuit 16 adds the gray scale data D(i, j) corresponding to the pixel of the i-th row and the j-th column and an auxiliary data $D_\alpha$(i, j) converted according to the gray scale degree designated by the gray scale data D(i, j), converts the added data into the analog voltage signal and supplies it to the data line 112 of the j-th column as the data signal X-j, during the horizontal scanning period that the scanning signal $G_{WRT-i}$ becomes the H level. Also, as the method of converting the gray scale data D(i, j) into the auxiliary data $D_\alpha$(i, j) according to the gray scale degree designated by the corresponding data, a calculating method such as the operation is considered, in addition to a method of using a table for previously storing the auxiliary data for each gray scale degree.

Since the voltage of the data signal X-j at this time corresponds to the added result of the gray scale data D(i, j) and the auxiliary data $D_\alpha$, it can be represented by $V_s$(i, j)+$V_\alpha$(i, j) when the analog-converted auxiliary data $D_\alpha$(i, j) is $V_\alpha$. Also, such a conversion operation is simultaneously performed with respect to the columns other than the j-th column, similarly to that of the first frame.

Furthermore, in the second frame, the data line driving circuit 16 converts the gray scale data D(i+1, j) corresponding to the pixel of the (i+1)-th row and the j-th column to the voltage signal $V_s$(i+1, j)+$V_\alpha$(i+1, j) and supplies it to the data line 112 of the j-th as the data signal X-j, during the horizontal scanning period that the next scanning signal $G_{WRT-(i+1)}$ becomes the H level.

In this way, in order to clarify the meaning of the added voltage $V_\alpha$(i, j) in the second frame, the operation of the pixel circuit 200 will be described by using the pixel circuit of the i-th row and the j-th column as the representative.

In addition, with respect to the pixel circuit, the operation can be divided into the first and second frames. Also, with respect to each frame, the operation can be divided into the selection period and the non-selection period of the scanning line 102. For this reason, the operation can be classified into four operations by the combination thereof.

Figure 5:
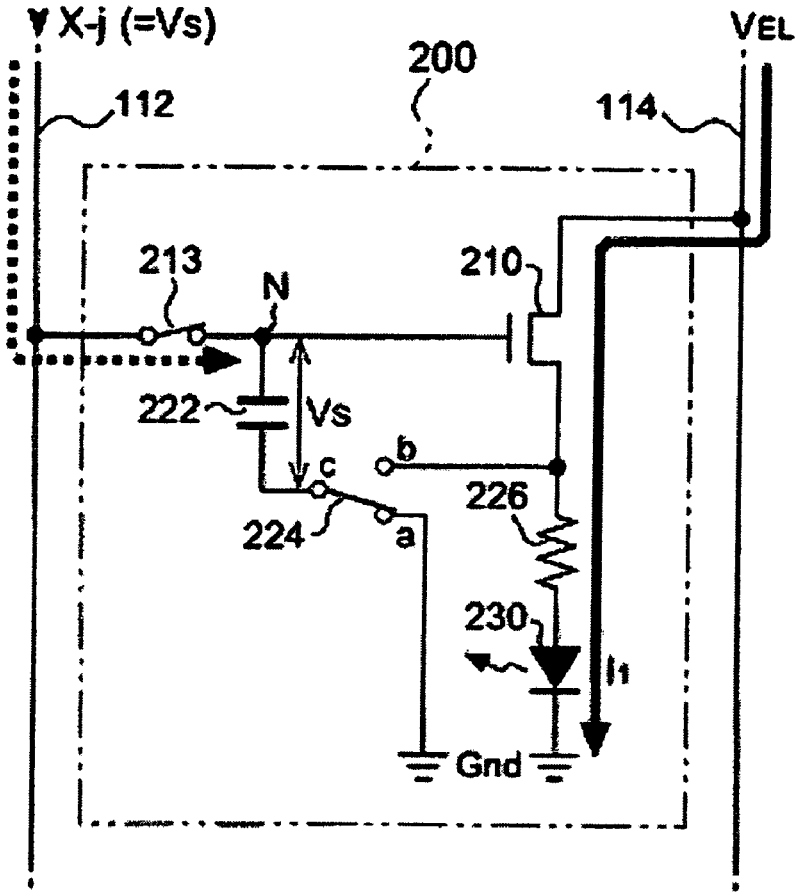
FIG. 5 is an explanatory view showing the operation of the pixel circuit.

First, in the first frame in which the frame signal FR is the L level, as shown in FIG. 5, the switching transistor 213 is turned on and the port c and the port a of the switch 224 are closed, during the period that the scanning signal $G_{WRT-i}$ becomes the H level (the selection period of the first frame).

Further, as described above, the data signal X-j has the voltage $V_s$(i, j). Here, if the voltage V(i, j) is simply represented as $V_s$, the node N has the voltage $V_s$. In addition, the voltage $V_s$ of the node N is held by the capacitive element 222.

The current flowing between the source and drain of the driving transistor 210 according to the voltage of the node N (that is, the gate voltage $V_s$) flows along the path of the power line 114→the driving transistor 210→the resistive element 226→the OLED element 230. At this time, the value of the current flowing into the OLED element 230 is represented as $I_1$.

Figure 6:
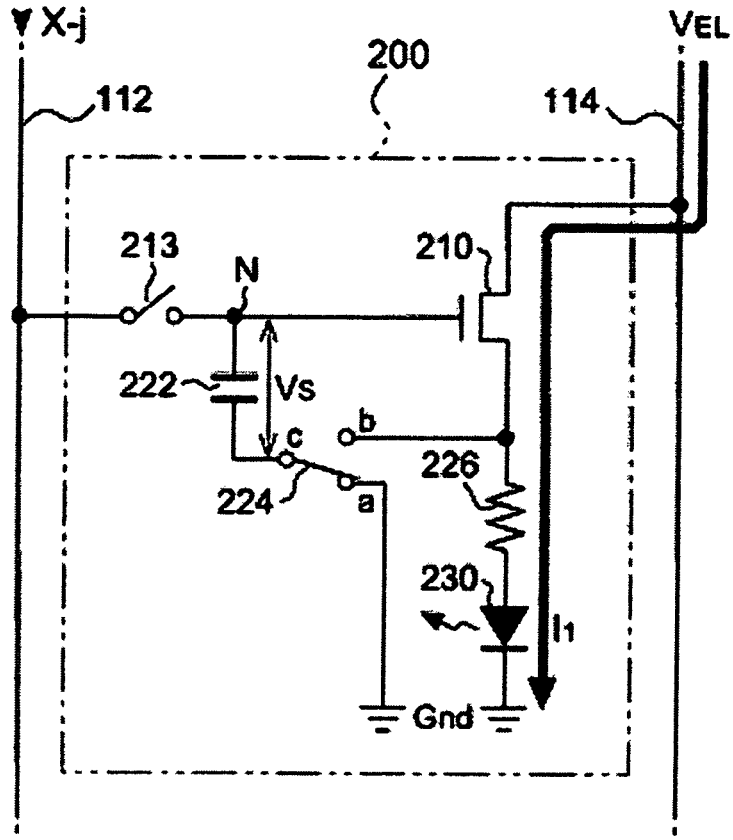
FIG. 6 is an explanatory view showing the operation of the pixel circuit.

Next, in the first frame, as shown in FIG. 6, the switching transistor 213 is turned off, but the closed state between the port c and the port a of the switch 224 is continuously sustained, during the period that the scanning signal $G_{WRT-i}$ becomes the L level (the non-selection period of the first frame). As a result, the node N holds the voltage $V_s$. Therefore, the current represented by the current value $I_1$ continuously flows into the OLED element 230.

Figure 7:
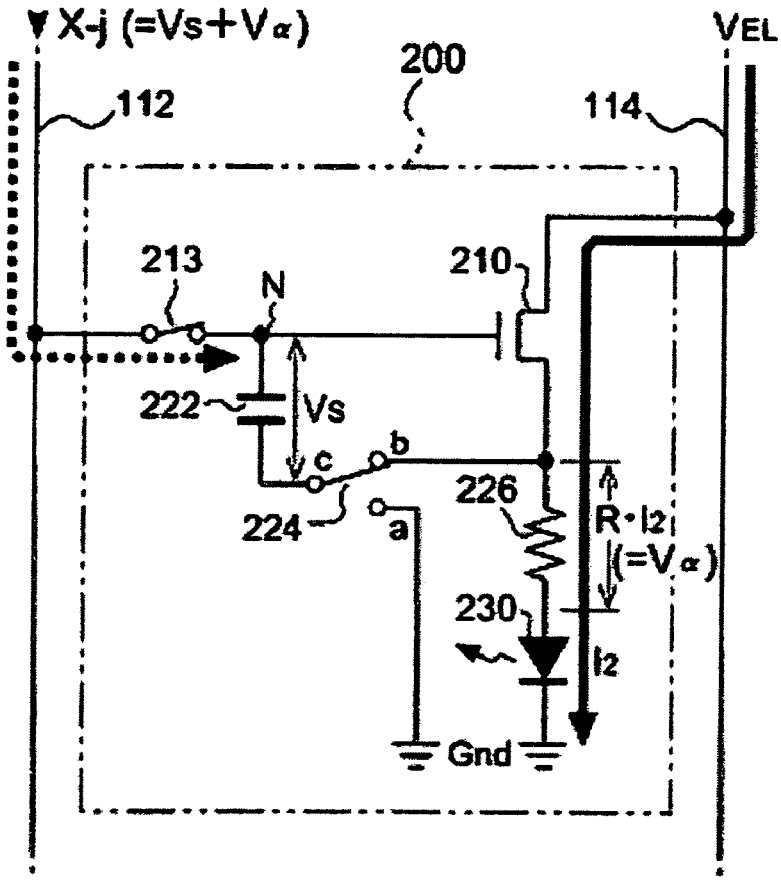
FIG. 7 is an explanatory view showing the operation of the pixel circuit.

Subsequently, in the second frame in which the frame signal FR is the H level, as shown in FIG. 7, the switching transistor 213 is turned on and the control signal $G_{SL-i}$ becomes the L level, during the period that the scanning signal $G_{WRT-i}$ becomes the H level (the selection period of the second frame). As a result, the port b is selected in the switch 224 and thus the ports c and b are closed.

Further, as described above, the data signal X-j has the voltage $V_s(i, j)+V_\alpha(i, j)$. Here, if the voltage $V_\alpha(i, j)$ is simply represented as $V_\alpha$, the node N has the voltage $(V_s+V_\alpha)$. Therefore, the current according to the corresponding voltage flows through flows along the path of the power line 114→the driving transistor 210→the resistive element 226→the OLED element 230. At this time, the value of the current flowing into the OLED element 230 is represented as $I_2$.

When representing the resistive value of the resistive element 226 as R, the voltage drop of the resistive element 226 becomes $R \cdot I_2$. If the voltage drop of the OLED element 230 can be ignored, the voltage of the other end of the capacitive element 222 is $R \cdot I_2$ which is equal to the voltage drop of the resistive element 226.

Therefore, the voltage held between both terminals of the capacitive element 222 is as follows.

$$V_s+V_\alpha-R \cdot I_2$$

Figure 8:
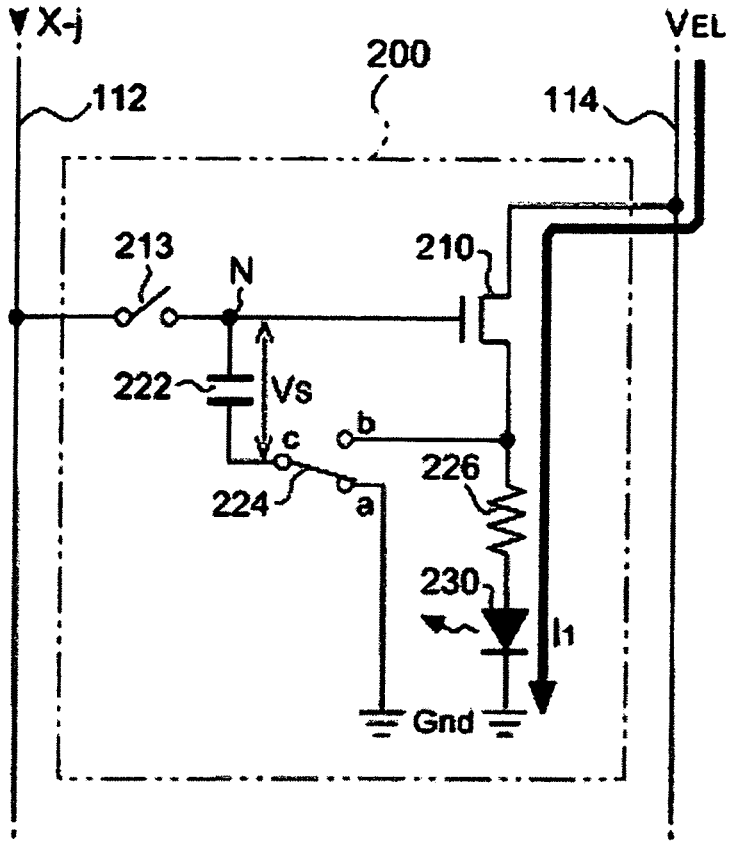
FIG. 8 is an explanatory view showing the operation of the pixel circuit.

Next, in the second frame, as shown in FIG. 8, the switching transistor 213 is turned off, and the state of the switch 224 is returned to the closed state between the ports c and a, during the period that the scanning signal $G_{WRT-i}$ becomes the L level (the non-selection period of the second frame). As a result, since the voltage of the node N becomes the voltage across the capacitive element 222 during the selection period of the second frame, the voltage is as follows.

$$V_s+V_\alpha-R \cdot I_2$$

In the present embodiment, in the first frame, when selecting the scanning line 102, the operation of writing the voltage corresponding to the gray scale degree of the pixel into the node N is performed in each pixel circuit located at the selected row. Since this operation is performed whenever the scanning line 102 is selected, the writing operations for all pixel circuits of the 320 rows and the 240 columns are completed when the scanning lines 102 of the first to 320-th rows are selected.

On the other hand, in the second frame, when the scanning line 102 is selected, the operation of writing the added voltage of the voltage corresponding to the gray scale degree of the pixel and the auxiliary voltage into the node N is performed in each pixel circuit located at the selected row. Further, when all the scanning lines 102 of the first to 320-th rows are selected, the writing operations for all the pixel circuits of 320 rows and 240 columns are completed.

In addition, during any one of the non-selection periods of the first and second frames, the operation of causing the current according to the voltage of the node N to flow into the OLED element 230 and the resistive element 226 is continuously performed.

However, in the present embodiment, the value of the current flowing into the OLED element 230 according to the gray scale data in the first frame is $I_1$ and the current must flow into the OLED element 230 during the non-selection period of the second frame. To do so, the voltage of the node N may be $V_s$ during the non-selection period of the second frame and the condition thereof is $V_\alpha=R \cdot I_2$.

To satisfy this condition, the added voltage $(V_s+V_\alpha)$ is applied to the node N and the voltage $V_\alpha$ is set to be equal to the voltage drop $R \cdot I_2$ of the resistive element 226 when causing the current with the value $I_2$ to flow into the resistive element 226 by the driving transistor 210 having the added voltage as the gate voltage.

In addition, the current value $I_2$ is determined according to the voltage $(V_s+V_\alpha)$ of the node N. Among them, since the voltage $V_s$ is changed according to the gray scale degree of the pixel, it is necessary that the voltage $V_\alpha$ be changed according to the gray scale degree. In consideration of this point, in the algorithm shown in FIG. 4B, the auxiliary data $D_\alpha(i, j)$ which is the component of the voltage $V_\alpha$ is changed according to the gray scale degree designated by the gray scale data D(i, j).

As such, during the selection period of the second frame, the switching transistor 213 is turned on, the voltage $(V_s+V_\alpha)$ is applied to one end of the capacitive element 222 through the node N, the ports c and b of the switch 224 are closed, and $R \cdot I_2$ $(=V_\alpha)$ which is the voltage drop of the resistive element 226 is applied to the other end of the capacitive element 222. During the non-selection period of the second frame, the switching transistor 213 is turned off, the ports c and a of the switch 224 are closed, and the current with the value $I_1$ is caused to continuously flow into the OLED element 230 by dropping the voltage of the other end of the capacitive element by the voltage drop $R \cdot I_2$ applied by that time (to the potential Gnd).

However, this content is applied in the case in which there is no deviation in the characteristics of the driving transistor 210. Next, the case in which there is a deviation in the characteristic of the driving transistor 210 will be described.

First, during the selection period and the non-selection period of the first frame, in the case in which the voltage of the node N is $V_s$, the value of the current flowing into the OLED element 230 is represented by $(I_1+\Delta I_1)$. The $\Delta I_1$ represents the current error generated by the deviation in the characteristic of the driving transistor 210 and may take the positive value or the negative value.

Next, during the selection period of the second frame, when the node N becomes the voltage $(V_s+V_\alpha)$, the value of current flowing into the OLED element 230 and the resistive element 226 is represented by $(I_2+\Delta I_2)$.

Here, since the current controlled by the same driving transistor 210 flows into the resistive element 226 over the first and second frames, the relationship of $I_1$ and $I_2$ becomes $|I_1| \leqq |I_2|$ and $I_1$ and $I_2$ have the same polarity.

Specifically, in the present embodiment, the driving transistor 210 is the n-channel type, the voltage of the node N during the selection period of the second frame is higher than the voltage of the node N in the first frame by the voltage $V_s$ Therefore, if the error current value $I_1$ is the positive value, the error current value $I_2$ is the positive value, and if the error current value $I_1$ is the negative value, the error current value $I_2$ is the negative value. The absolute value of the error current value $I_2$ is higher than the absolute value of the error current value $I_1$.

On the other hand, during the selection period of the second frame, the voltage at the other end of the capacitive element 222 is $R \cdot (I_2+\Delta I_2)$ which is the voltage drop of the resistive element 226. As described above, since the relationship $V_\alpha=R \cdot I_2$ is set, the voltage at the other end of the capacitive element 222 can be represented by $(V_\alpha+R \cdot \Delta I_2)$. Therefore, during the selection period of the second frame, the voltage held across the capacitive element 222 becomes $(V_s-R \cdot \Delta I_2)$ obtained by subtracting $(V_\alpha+R \cdot \Delta I_2)$ from $(V_s+V_\alpha)$.

During the non-selection period of the same frame, the switching transistor 213 is turned off and the other end of the capacitive element 222 is connected to the potential Gnd. As a result, the voltage of the node N becomes $(V_s-R \cdot \Delta I_2)$ held by the capacitive element 222.

If the voltage of the gate of the driving transistor 210 is $V_s$, the current flowing into the OLED element 230 is $I_1$. Therefore, if the change amount of the current value according to $R \cdot \Delta I_2$ which is the change (reduction) amount of the gate voltage is represented by $\Delta I_2$, the value of the current flowing into the OLED element 230 during the non-selection period of the second frame is as follows.

$$I_1 - \Delta I_2$$

Here, since the current value flowing into the OLED element 230 is $(I_1+\Delta I_1)$ during the non-selection period of the first frame and is $(I_1-\Delta I_2)$ during the non-selection period of the second frame, the effective current value $I_{eff}$ flowing into the OLED element 230 is expressed by a next Equation by using two frames of the first and second frames as an unit time.

$$I_{eff} = \sqrt{\frac{(I_1 + \Delta I_1)^2 + (I_1 - \Delta I_2)^2}{2}} \quad (1)$$

In Equation 1, if the square terms of $\Delta I_1$ and $\Delta I_2$ become approximately zero, it is simplified by the following Equation.

$$I_{eff} = I_1\sqrt{1+2(\Delta I_1 - \Delta I_2)} \quad (2)$$

In Equation 2, since $\Delta I_1$ and $\Delta I_2$ have the same polarity, the effective current value $I_{eff}$ is offset to approach to $I_1$.

The values of $\Delta I_1$ and $\Delta I_2$ depend on the current (that is, the pixel gray scale level) flowing into the OLED element 230, the resistive value R of the resistive element 226, or the characteristic of the driving transistor 210. However, if $\Delta I_1$ and $\Delta I_2$ in Equation 1 are small, each square term can be ignored, so that it can be equal substantially to Equation 2.

In addition, upon calculating the effective current value, the selection period of the first and second frames should be considered. However, since the length of the selection period is sufficiently short compared to the length of the non-selection period, it will be ignored in Equations 1 and 2.

In the present embodiment, although the error current $\Delta I_1$ increases in the first frame by the existence of the deviation in the characteristics of the driving transistor 210, the error current $\Delta I_2$ for erasing the error current $\Delta I_1$ to make the error current zero flows in the second frame. As a result, when viewing the first and second frames, the effective current value flowing into the OLED element 230 becomes approach to the value $I_1$ which is a target current corresponding to the gate voltage $V_s$. Therefore, according to the present embodiment, although there is the deviation in the characteristics of the driving transistor 210, the influence thereof decreases in each pixel circuit.

Figure 9:
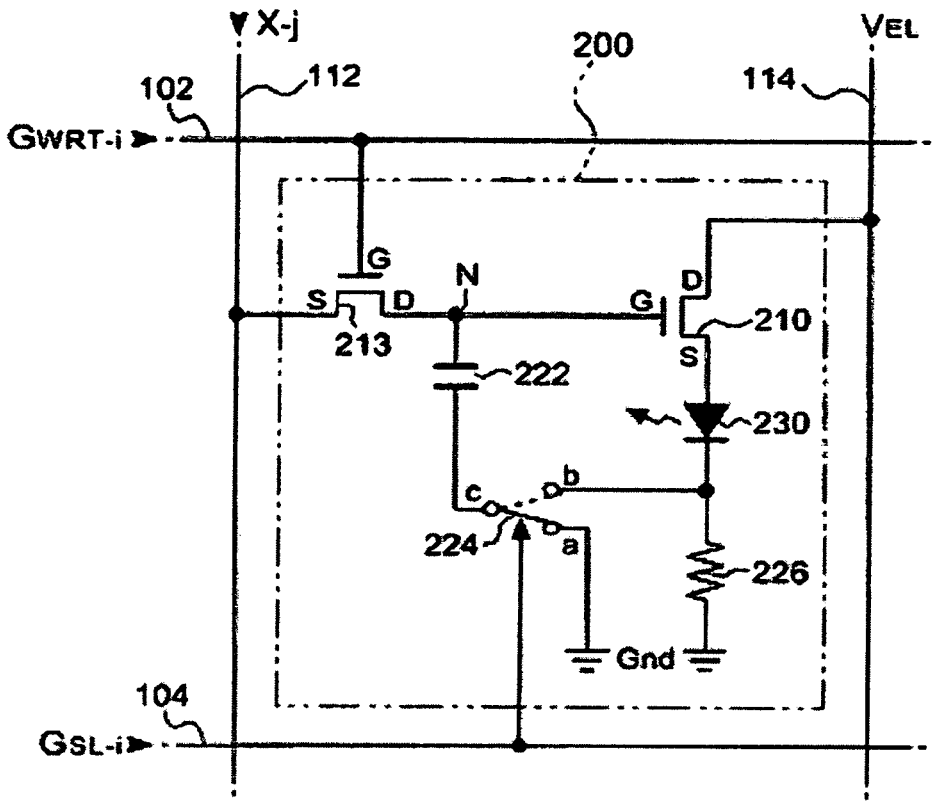
FIG. 9 is a diagram showing an example of the pixel circuit.

In addition, although in the above-described embodiment, the source of the driving transistor 210 is connected to one end of the resistive element 226 and the other end of the resistive element 226 is connected to the anode of the OLED element 230. However, as shown in FIG. 9, the structure that the source of the driving transistor 210 is connected to the anode of the OLED element 230 and the cathode of the OLED element 230 is connected to one end of the resistive element 226 may be used.

Furthermore, the OLED element 230 may be inserted between the power line 114 and the drain of the driving transistor 210 and the OLED element 230 and the resistive element 226 may be located with the driving transistor 210 interposed therebetween.

Figure 10:
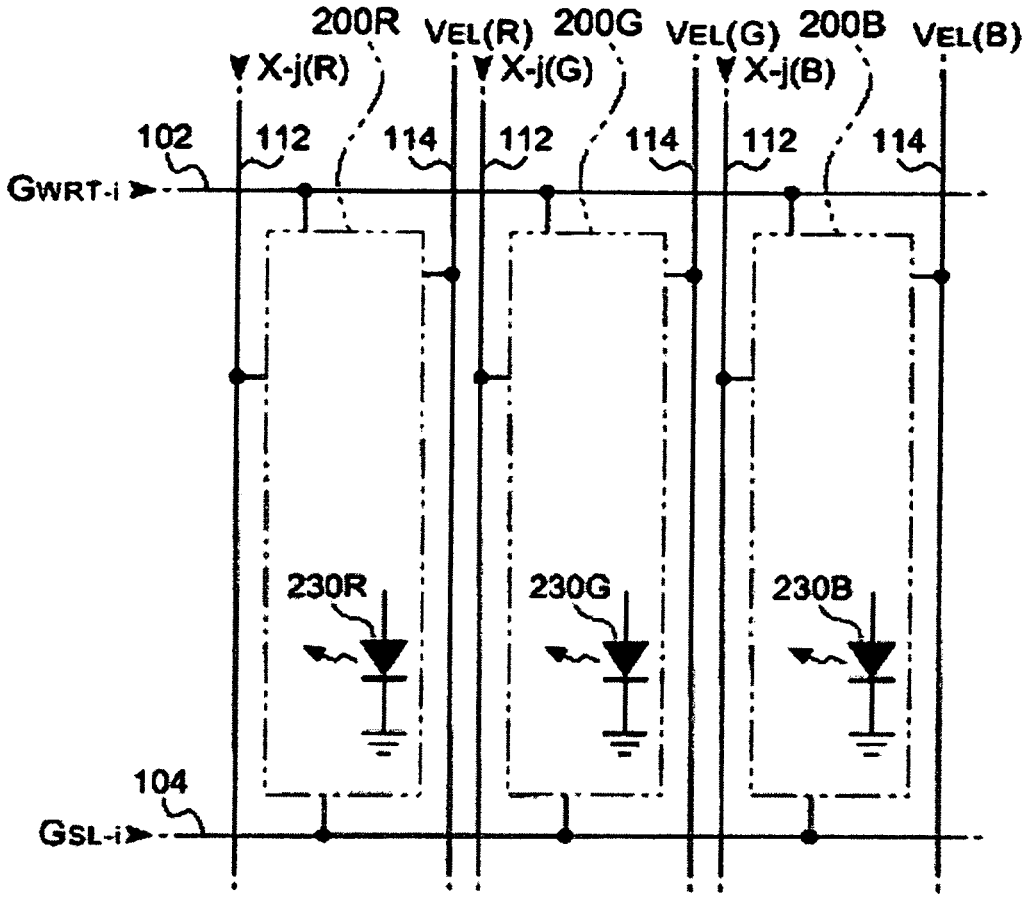
FIG. 10 is a diagram showing an arrangement example of the pixel circuit in the case of implementing the color display.

Although the gray scale display for a monochrome pixel is performed in the present embodiment, for example, as shown in FIG. 10, pixel circuits 200R, 200G and 200B may be arranged so as to correspond to R (Red), G (Green) and B (Blue) and these three pixels constitute one dot to perform the color display. Also, in the case of implementing the color display, the light-emitting layer is selected such that the OLED elements 230R, 230G and 230B emit the light with red, green and blue colors, respectively.

In the structure of achieving the color display, when the light-emitting efficiencies of the OLED elements 230R, 230G and 230B are different from each other, the power supply voltage $V_{EL}$ must be different for each color.

Although the period for switching the first and second frames is different according to the use thereof in the above-described embodiment, for example, in the case of the display device, the period lower than 1/30 sec. is preferable, and the period lower than 1/60 sec. and higher than 1/120 sec. is more preferable. Thereby, the flicker occurred due to the change of the light-emitting luminance in both frames can be efficiently suppressed.

Also, at such a switching period, the first and second frames are performed in order of the first frame, the first frame, the second frame and the second frame, not being alternately performed.

Furthermore, although the switching of the first and second frames is performed in the unit of the surface in the above-described embodiment, it may be performed in the pixel unit, the row unit, the column unit or the block unit composed of a plurality of the pixels. Specifically, during the same vertical scanning period, the pixel driven in the first frame and the pixel driven in the second frame may be mixed. If the pixels are mixed, the difference of the luminance of the pixel is not visible although the difference of the luminance of the pixel is generated in the first and second frames.

Moreover, although the driving transistor 210 is the n-channel type in the embodiment, it may be p-channel type. It is similar with respect to the channel type of the switching transistor 213. Also, the switching transistor 213 may be composed of a transmission gate obtained by combining the p-channel type and the n-channel type in the complementary type.

In addition, the OLED element 230 is an example of the current driving element. Instead of this, another light-emitting element such as an inorganic EL element, a field emission element (FE) and a LED, an electrophoresis element or an electrochromic element may be used.

Figure 11:
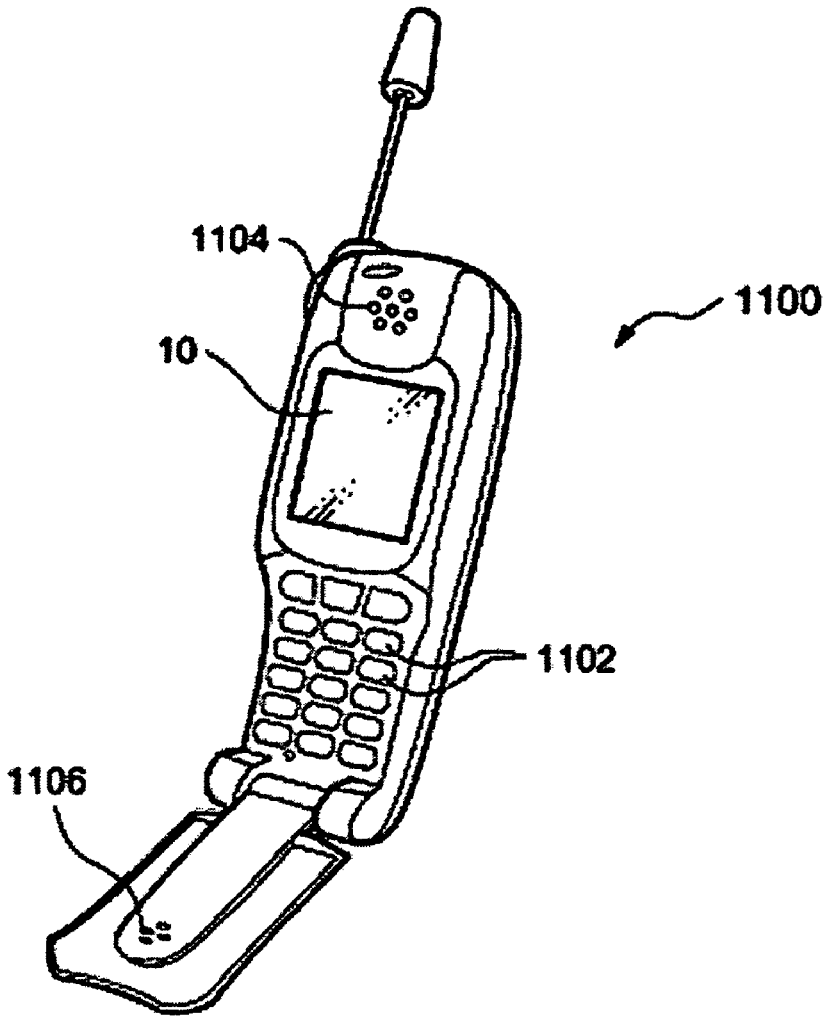
FIG. 11 is a diagram showing a cellular phone using the electro-optical device.

Next, an example of using the electro-optical device according to the above-described embodiment in an electronic apparatus will be described. First, a cellular phone in which the above-described electro-optical device 10 is applied to a display unit will be described. FIG. 11 shows the structure of the cellular phone.

In FIG. 11, a cellular phone 1100 includes a plurality of operation buttons 1102, an earpiece 1104, a mouthpiece 1106, and the above-described electro-optical device 10 serving as the display unit.

Figure 12:
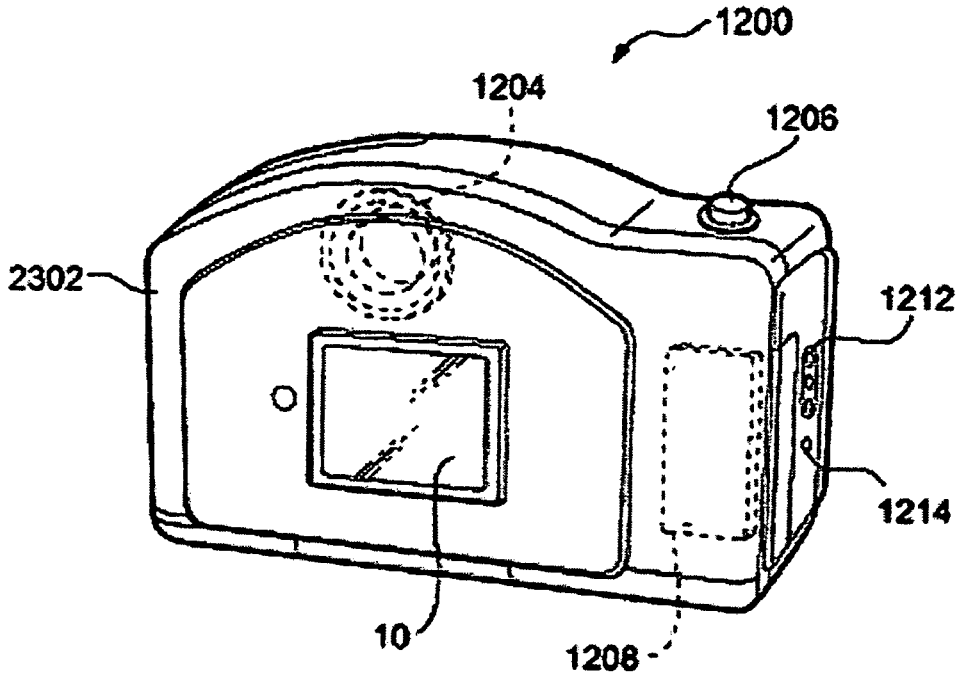
FIG. 12 is a diagram showing a digital still camera using the electro-optical device.

Next, a digital still camera in which the above-described electro-optical device 10 is used in a finder will be described. FIG. 12 shows the rear surface of the digital still camera. A film camera exposes the film to the light by an optical image of a subject. However, the digital still camera 1200 causes the optical image of the subject to be subjected to the photoelectric conversion by an image pickup device such as a CCD (charge coupled device) to generate and store the imaged signal. Here, a display surface of the above-described electro-optical device 10 is provided on the rear surface of the case 1202 in the digital still camera 1200. Since the electro-optical device 10 performs the display based on the imaged signal, it functions as the finder for displaying the subject. Also, a light receiving unit 1204 including an optical lens or the CCD is provided on the front surface of the case 1202 (rear surface side in FIG. 12).

If a cameraman confirms the image of the subject displayed by the electro-optical device 10 and presses a shutter button 1206, the imaged signal of the CCD at this time is transmitted to and stored in a memory of a circuit substrate 1208. In addition, in the digital still camera 1200, a video signal output terminal 1212 for performing external display and an input/output terminal 1214 for data communication are provided on the side of the case 1202.

Further, as the electronic apparatus, in addition to the cellular phone of FIG. 11 or the digital still camera of FIG. 12, it may be a television, a view-finder-type and monitor-direct-view-type video tape recorder, a car navigation device, a pager, an electronic organizer, a calculator, a word processor, a work station, a video phone, a POS terminal, and an apparatus having a touch panel. The above-described electro-optical device can be applied as the display units of various electronic apparatuses. Also, it is not limited to the display units of the electronic apparatus for directly displaying the image or the character and can be applied to a light source (for example, a line head) of a printing apparatus used for indirectly forming the image or the character by irradiating the light to a photosensitive material.

What is claimed is:

1. A pixel circuit comprising:

a driving transistor for making a current according to a gate voltage to flow into a driven element;

a resistive element electrically connected in series to the driven element;

a capacitive element whose one end is connected to a gate of the driving transistor;

a switching transistor provided between the gate of the driving transistor and a data line to be turned on/off; and a single pole double throw switch whose common port is connected to the other end of the capacitive element, one port is connected to a potential line held with a predetermined potential, and the other port is connected to one end of the resistive element, a selection period and a non-selection period of a first frame and a selection period and a non-selection period of a second frame being continuous, during the selection period of the first frame, the switching transistor being turned on and a voltage according to a target current flowing in the driven element being applied to the data line, during the non-selection period of the first frame, the switching transistor being turned off, during the selection period of the second frame, the switching transistor being turned on, and during the non-selection period of the second frame, the switching transistor being turned off, the signal pole double throw switch closing the common port and the one port thereof during the selection period and the non-selection period of the first frame and the non-selection period of the second frame, and closing the common port and the other port during the selection period of the second frame.

2. The pixel circuit according to claim 1, the driven element being an electro-optical element which emits the light with the luminance according to the flowing current.

3. An electro-optical device comprising:

a plurality of pixel circuits provided to correspond to intersections of scanning lines and data lines;

a scanning line driving circuit for driving the scanning lines; and a data line driving circuit for driving the data lines, each pixel circuit having a driving transistor which makes a current according to a gate voltage flow into an electro-optical element for emitting the light with the luminance according to the flowing current;

a resistive element electrically connected in series to the driven element;

a capacitive element whose one end is connected to a gate of the driving transistor;

a switching transistor provided between the gate of the driving transistor and the data line to be turned on/off; and a single pole double throw switch whose common port is connected to the other end of the capacitive element, one port is connected to a potential line held with a predetermined potential, and the other port is connected to one end of the resistive element, a selection period and a non-selection period of a first frame and a selection period and a non-selection period of a second frame being continuous, during the selection period of the first frame, the single pole double throw switch closing the common port and the one port thereof, the scanning line driving circuit turning on the switching transistor, the data line driving circuit applies a voltage according to a target current flowing into the driven element to the data line, during the non-selection period of the first frame, the scanning line driving circuit turning off the switching transistor, during the selection period of the second frame, the single pole double throw switch closing the common port and the other port thereof, and the scanning line driving circuit turning on the switching transistor, and during the non-selection period of the second frame, the single pole double throw switch closing the common port and the one port thereof, and the scanning line driving circuit turning off the switching transistor.

4. An electronic apparatus having the electro-optical device according to claim 3.

5. The pixel circuit according to claim 1, the target current being the current flowing into a display element according to predetermined gray scale data during the selection period of the first frame.

6. The electro-optical device according to claim 3, the target current being the current flowing into a display element according to predetermined gray scale data during the selection period of the first frame.

* * * * *